US005188066A

United States Patent [19]

Gustavsson

[11] Patent Number: 5,188,066

[45] Date of Patent: Feb. 23, 1993

[54] INTERNAL COMBUSTION ENGINE

[75] Inventor: Alvar Gustavsson, Skärblacka, Sweden

[73] Assignee: Skarblacka Bil & Motor AB, Skarblacka, Sweden

[21] Appl. No.: 777,564

[22] PCT Filed: Jun. 19, 1990

[86] PCT No.: PCT/SE90/00439

§ 371 Date: Dec. 5, 1991

§ 102(e) Date: Dec. 5, 1991

[87] PCT Pub. No.: WO90/15919

PCT Pub. Date: Dec. 27, 1990

[51] Int. Cl.[5] ..... F02B 75/04

[52] U.S. Cl. ..... 123/48 A; 123/78 A; 123/51 BB

[58] Field of Search ..... 123/48 A, 48 AA, 78 A, 123/48 R, 51 R, 51 BB, 51 B

[56] References Cited

U.S. PATENT DOCUMENTS

| | | | |
|---|---|---|---|
| 1,099,576 | 6/1914 | Slaby | 123/78 A |
| 1,162,054 | 11/1915 | Hansen | 123/78 A |
| 1,590,940 | 6/1926 | Hallett | 123/78 A |
| 1,707,005 | 3/1929 | Hall | 123/48 A |
| 1,719,752 | 7/1929 | Brown | 123/78 A |
| 4,104,995 | 8/1978 | Steinbock | 123/78 A |
| 4,143,628 | 3/1979 | Gustavsson | 123/78 A |
| 4,169,435 | 10/1979 | Faulconer | 123/78 A |
| 4,625,684 | 12/1986 | Van Avermarte | 123/78 A |
| 4,708,096 | 11/1987 | Mroz | 123/78 A |
| 5,007,384 | 4/1991 | Blair | 123/48 A |

FOREIGN PATENT DOCUMENTS

| | | | |
|---|---|---|---|
| 3107382 | 10/1982 | Fed. Rep. of Germany | 123/78 A |
| WO80/00095 | 1/1980 | PCT Int'l Appl. | 123/78 A |

*Primary Examiner*—David A. Okonsky
*Attorney, Agent, or Firm*—Baker & Daniels

[57] ABSTRACT

The present invention relates to an arrangement for an internal combustion engine. The engine is of the kind which has a number of working cylinders (1, 2, 3, 4), each of which communicating with a corresponding auxiliary cylinder (5, 6, 7, 8). Each working cylinder has a working piston (9, 10, 11, 12) which is so arranged as to execute a reciprocating motion and, via a connecting rod (*9a, 10a, 11a, 12a*), the working piston is operatively connected to a first crankshaft (17). Each auxiliary cylinder (5–8) has an auxiliary piston (13, 14, 15, 16) which is so arranged as to execute a reciprocating motion and via a connecting rod (*9a–12a*), the auxiliary piston is operatively connected to a second crankshaft (18). Acting between the aforementioned crankshafts is a device (19, 20, 21) to ensure that the motion of the auxiliary piston (13–16) occurs in a relation to the motion of the working piston (9–12), and to provide angular displacement between the shafts (20, 21).

13 Claims, 3 Drawing Sheets

INTERNAL COMBUSTION ENGINE

The present invention relates to an arrangement for an internal combustion engine of the kind which has a number of working cylinders, a corresponding number of auxiliary cylinders, each of which communicates with an associated working cylinder, and in each working cylinder a working piston which is so arranged as to execute a reciprocating motion inside the working cylinder and which, via a connecting rod, is operatively connected to a first crankshaft, in each auxiliary cylinder an auxiliary piston which is so arranged as to execute a reciprocating motion inside the auxiliary cylinder and which, in a similar fashion to the working piston, is operatively connected to a second crankshaft and a device acting between the aforementioned crankshafts to ensure that the reciprocating motion of the auxiliary piston occurs at a frequency related to the frequency of the reciprocating motion of the working piston, and to provide angular displacement between the shafts with a view to the creation of a compression ratio in the respective working cylinders and auxiliary cylinders which is dependent upon the loading on the engine at any given time.

An engine of this construction is previously disclosed, for example, in SE A 7806909-3. Also described here are the advantages which are achieved in respect of thermal efficiency and the nature of the exhaust gases in an engine which exhibits a variable compression ratio. A common feature of previously disclosed engines with a variable, load dependent compression ratio is that energy is taken from the working piston for the purpose of controlling the motion of the auxiliary piston and its instantaneous position in the auxiliary cylinder via the aforementioned device acting between the crankshafts.

Although the engine disclosed through SE A 7806909-A thus exhibits positive features with regard to its efficiency and the composition of the exhaust gases as far as their effect on the environment is concerned, the object of the present invention is to make available an engine of even greater efficiency, in particular in the low-load range of the engine, with this being achieved in accordance with the invention in that the aforementioned device is so arranged as to transmit energy originating from the effect of the combustion on the respective auxiliary piston from the second crankshaft to the first crankshaft, and in that the operative connection between the respective auxiliary piston and the second crankshaft is so arranged as to allow the expansion motion of the auxiliary piston, that is to say its motion away from the working piston, to extend over more than 180° of the rotation of the second crankshaft, and to reduce the lateral forces of the auxiliary piston against the wall of the auxiliary cylinder, which generate frictional losses.

A further object, which is met by an engine in accordance with the invention, is to make available variable piston displacements which reduce the pumping and compression work of the engine.

In accordance with one particular characteristic of the invention, a preferred embodiment of the aforementioned device comprises toothed belt pulleys on the respective crankshafts, a toothed belt running around the belt pulleys, and means of a previously disclosed kind so arranged as to lengthen or shorten one section of the belt at the expense of the other section, in conjunction with which the aforementioned lengthening/shortening is executed so that the desired angular displacement is achieved, whereby an especially functional and economical construction is obtained.

An operative connection which imparts an expansion motion to the auxiliary piston over more than 180° of the rotation of the second crankshaft, and at the same time reduces its frictional losses, can be appreciated from a second particular characteristic, and in this case means that the operative connection between the respective auxiliary piston and the aforementioned second crankshaft is a connecting rod, and that the axis of rotation of the second crankshaft is displaced in parallel for a certain distance relative to an imaginary line connecting the central axes of the auxiliary cylinders, in conjunction with which the displacement takes place in a direction which coincides with that in which the crank web of the second shaft faces when the auxiliary piston is on its way into the auxiliary cylinder. The aforementioned distance of parallel displacement should preferably lie within the area of 15–35% of the diameter of the auxiliary cylinder, as can be appreciated from a particular characteristic of the invention.

An alternative embodiment of an operative connection of this kind can be appreciated from yet another particular characteristic of the invention, and in this case means that the operative connection between the respective auxiliary piston and the aforementioned second crankshaft is a rocker arm mechanism of a previously disclosed kind.

The invention is explained in greater detail below with reference to the accompanying drawings, in which FIG. 1 is a perspective view in diagrammatic form of a four-cylinder engine with an arrangement in accordance with the present invention.

Figure 1:
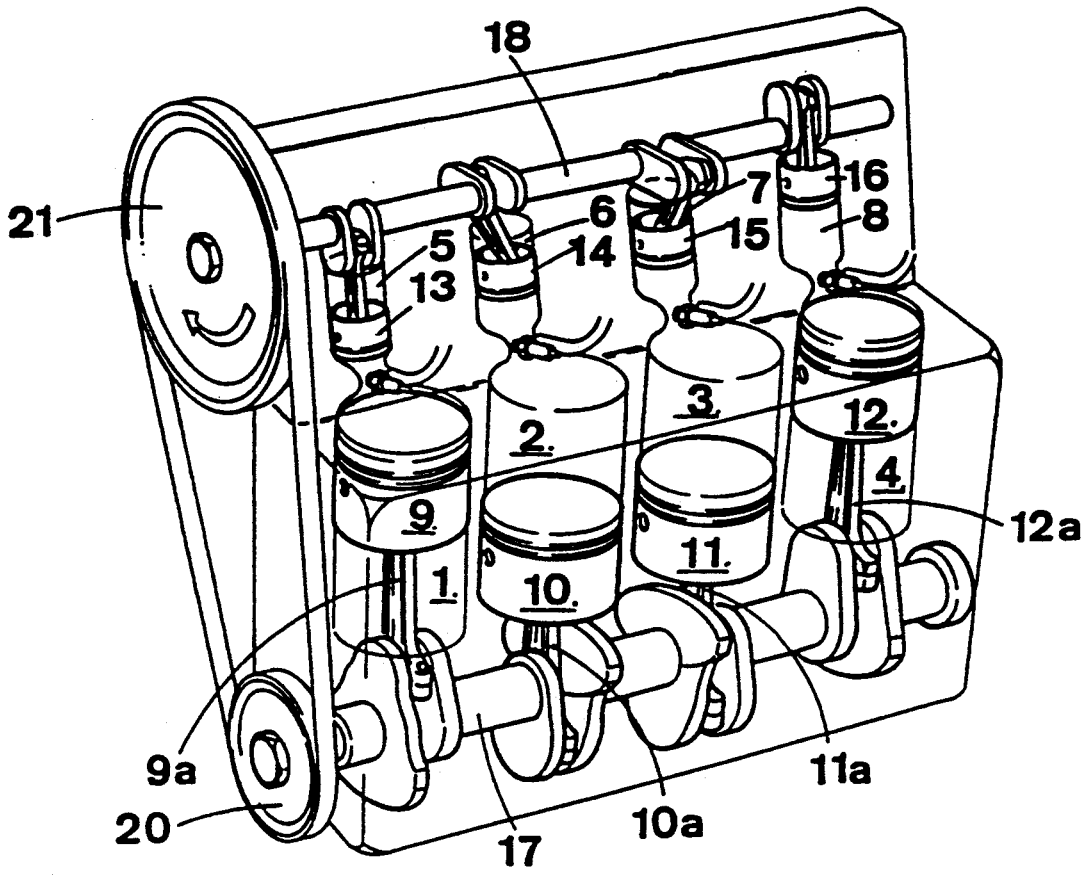

The engine in accordance with FIG. 1 exhibits four working cylinders 1, 2, 3 and 4, each of which communicates with a corresponding auxiliary cylinder 5, 6, 7 and 8. In each of the working cylinders 1–4, and similarly in the auxiliary cylinders 5–8, working pistons 9, 10, 11 and 12 and auxiliary pistons 13, 14, 15 and 16 are able to execute reciprocating axial motion. The working pistons 9–12 are operatively connected via connecting rods **9*a*–12*a* to a working crankshaft 17. The auxiliary pistons 13–16 are similarly operatively connected via connecting rods 13*a*–16*a* to an auxiliary crankshaft 18. Arranged between the crankshafts 17 and 18 are devices which, for the reasons described in the patent specification referred to by way of introduction, cause the reciprocating motion of the auxiliary pistons 13–16 to take place at a frequency related to the reciprocating motion of the working pistons 9–12, and cause an angular displacement between the crankshafts 17, 18**, such as to produce in the working cylinders and in the auxiliary cylinders a compression ratio which is dependent on the loading on the engine at any given time. In the case of a four-stroke engine, the frequency of the reciprocating motion of the auxiliary pistons is one half of the frequency of the working pistons. In the case of a two-stroke engine, the aforementioned frequencies are identical. The invention is now explained below in more detail in relation to a four-stroke engine application, with reference to the drawings.

The dependence referred to above is in this case such that the compression ratio is at its lowest under high loading, and at its highest under low loading, that is to say the respective positions of the working pistons and the auxiliary pistons at the moment of ignition, are closest to one another under low load and are furthest away from one another under high load. During the cycle of the working piston 9, which comprises the induction, compression, power and exhaust strokes, during which strokes the working piston 9 moves down, up, down and up, the associated auxiliary piston 13 moves up both during parts of the induction stroke and during the compression and expansion strokes. As will be appreciated from the following, this has been made possible in accordance with the invention in that an operative connection of the kind referred to by way of introduction between the auxiliary piston and the second crankshaft 18, which connection permits the expansion motion of the auxiliary piston 13, that is to say its upward motion during the induction stroke of the working piston, to extend over more than 180° of the rotation of the second crankshaft 18.

A characteristic feature of the invention is that the aforementioned devices acting between the crankshafts are able to transmit energy originating from the effect of the combustion on the respective auxiliary piston 13–16, from the crankshaft 18 to the crankshaft 17. This transmission of energy is effective in particular in the low load range of the engine and contributes to an improved degree of efficiency relative to previously disclosed engines.

The reason why this transmission of energy from the effect of combustion on the auxiliary pistons to the crankshaft 17 contributes in such a particularly effective manner to the high degree of efficiency of the four stroke engine in accordance with the invention is that the auxiliary pistons move at a comparatively low speed, which in itself leads to low frictional losses. Compared with the working pistons, the auxiliary pistons take energy from the combustion process during a much larger proportion of the cycle of the engine than is the case for the working pistons. The reduced induction and compression work and the lower maximum combustion temperature also contribute to lower losses in both four-stroke and two-stroke engines It was thus possible, in a four-stroke test engine in accordance with the invention and at a certain degree of loading, to measure a generated effect on the auxiliary crankshaft 18 as high as approximately 1/5 of the effect generated on the working crankshaft 17, in conjunction with which, however, the frictional losses via the auxiliary crankshaft 18 were only 1/15 of the frictional loss via the working crankshaft 17.

In the embodiment illustrated in the drawings, the aforementioned device consists of a toothed belt 19 which runs around toothed belt pulleys 20, 21 arranged on the crankshafts 17 and 18. The toothed belt pulley 21, in this case for a four-stroke engine, has a diameter which is twice as large as the diameter of the toothed belt pulley 20, in order for the auxiliary pistons 13–16 to execute their reciprocating motion in the manner described above, that is to say at a frequency which is one half as great as the frequency of the working pistons 9–12. In the case of a two-stroke engine the toothed belt pulleys 20, 21 have identical diameters, so that the frequency of the reciprocating motion of both the working pistons and the auxiliary pistons is identical.

Figure 2:
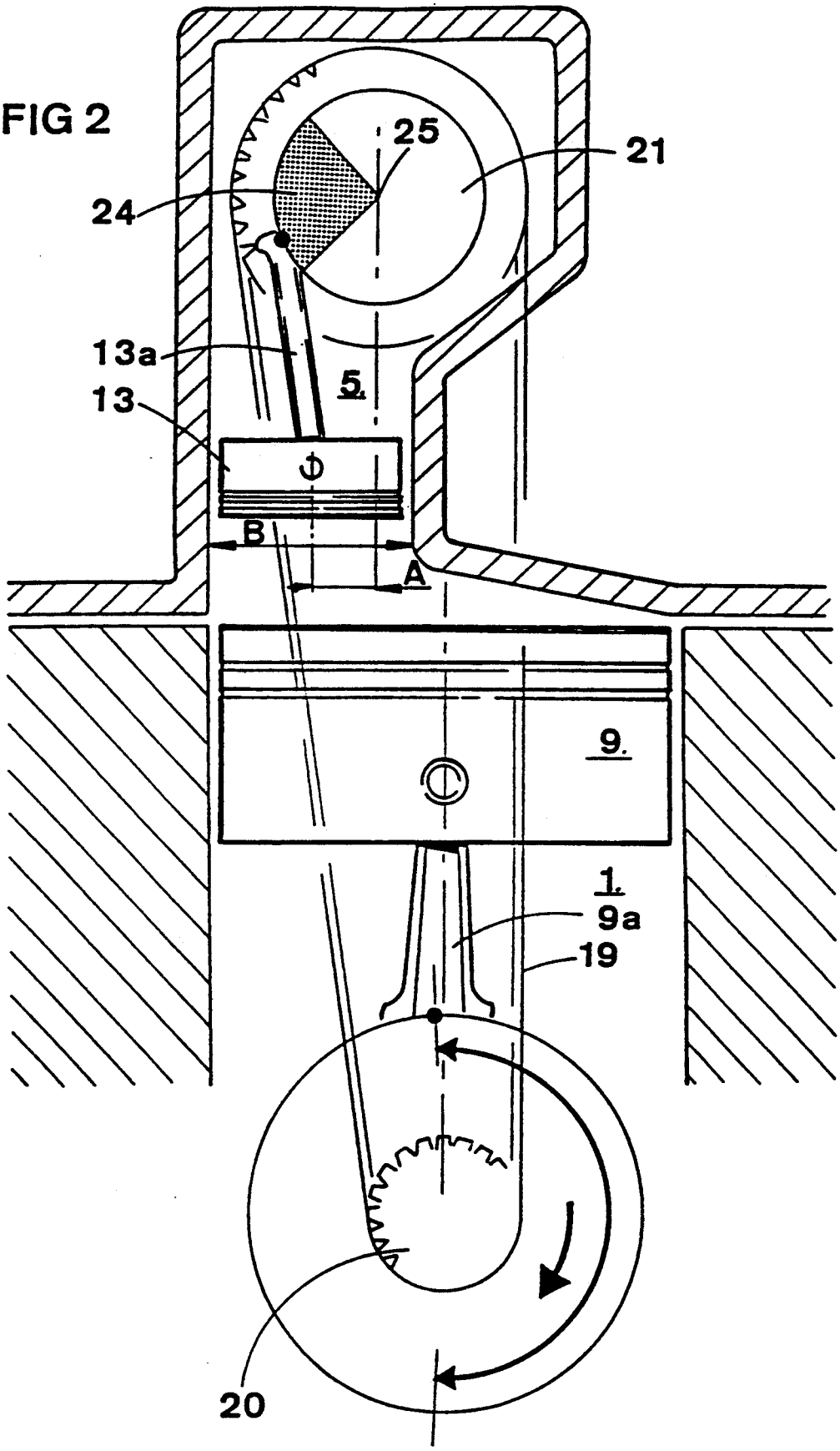
FIG. 2 shows a section in diagrammatic form through an engine according to FIG. 1, with a first embodiment of an operative connection between an auxiliary piston and said second crankshaft.

The aforementioned angular or phase displacement between the crankshafts can thus by produced by some previously disclosed method, for example by lengthening one section of the belt 19 at the expense of the other section, as described in U.S. Pat. No. 4,104,995. The actual angular or phase displacement can be seen in FIG. 2 as a sector 24 of a circle marked with a pattern of dots. Otherwise this Figure and FIG. 3 use the same reference designations as are used in FIG. 1 for the cylinder 1 nearest the belt 19 and the associated parts of the engine.

A second characteristic feature of the internal combustion engine in accordance with the present invention is that the centre of rotation 23 of the auxiliary crankshaft 18 is displaced by a certain distance A relative to an imaginary line 24 connecting the central axes of the auxiliary cylinders 5–8. The displacement in this case is such that the distance A amounts to 15–35% of the diameter B of the auxiliary cylinder 5. This lateral parallel displacement, known as the offset, contributes to reduced lateral forces acting on the auxiliary pistons and consequently to reduced frictional losses in relation to what is achieved in a conventional engine, and thus to a further improvement in the degree of efficiency of the engine in accordance with the invention. The lateral parallel displacement also contributes to an increased length of stroke for the auxiliary pistons 13–16, and to an expansion motion for the auxiliary pistons over more than 180° of the rotation of the working crankshaft 17.

With regard to the positive effect of the displacement A on the degree of efficiency of the engine in accordance with the invention, the lower frictional losses can be attributed first and foremost to the low guide forces acting on the auxiliary pistons which have been achieved.

Figure 3:
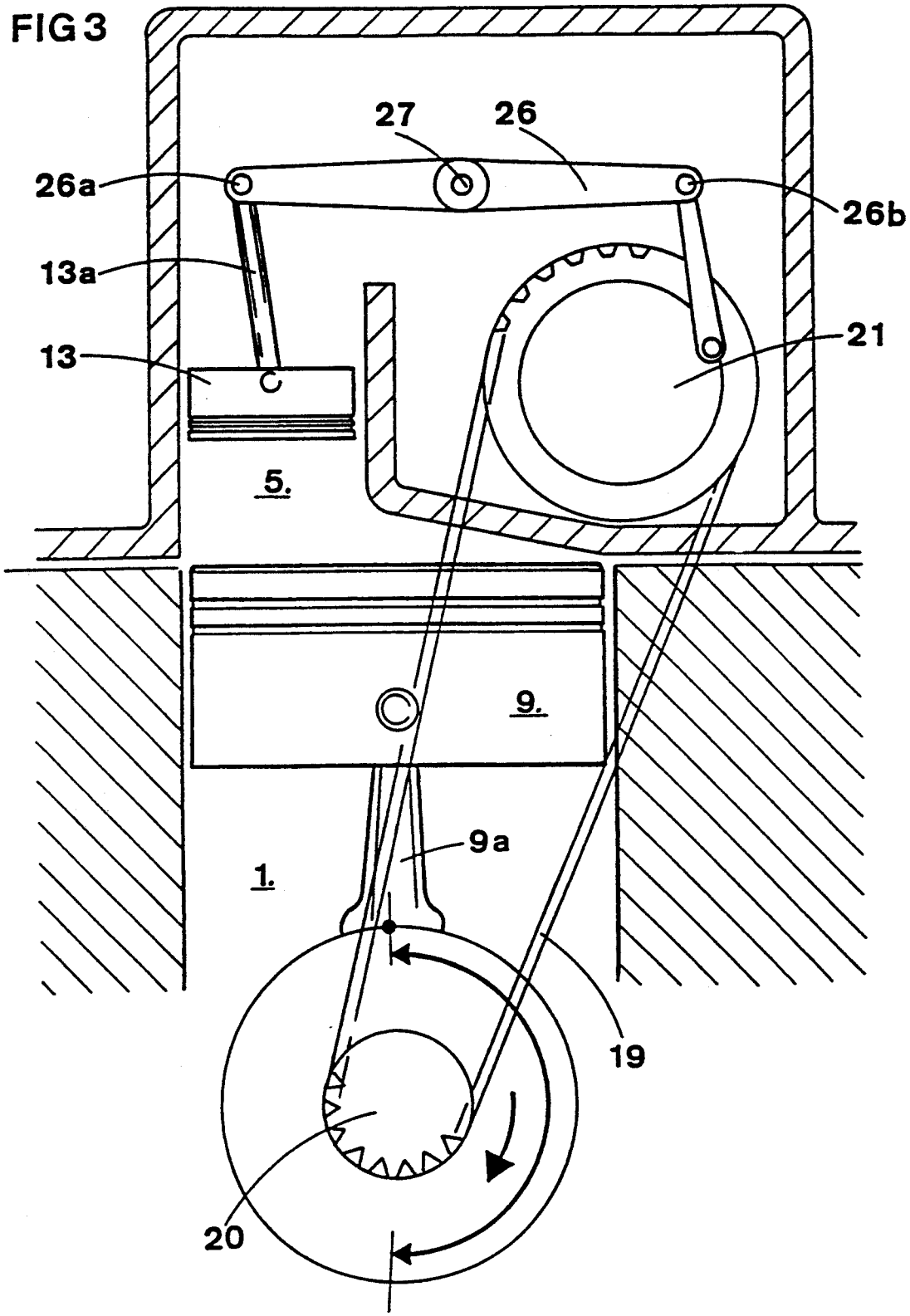
FIG. 3 shows similarly to FIG. 2 an alternative embodiment of the aforementioned operative connection.

An alternative embodiment of an engine in accordance with the invention to achieve low guide forces and an even higher degree of expansion motion over an even greater proportion of the rotation of the working crankshaft 17 than has previously been disclosed is shown in FIG. 3. The operative connection between the auxiliary piston 13 and the second crankshaft 18 is a rocker arm 26 which is pivotally mounted on a shaft 27, and one end of which is attached to the connecting rod **13*a*. The other end of the rocker arm 26 is connected to the auxiliary crankshaft 18 via a link arm 26*a*. The rocker arm 26 has been given a design such that a pivot point 26*a* between the rocker arm 26 and the connecting rod 13*a* lies essentially above the centre of the auxiliary piston 13 during the up-and-down motion of the piston 13, which means that this is subjected to only small guide forces. Another advantage associated with the rocker arm mechanism is that the lateral displacement, which takes place to a higher degree than that previously described, provides automatic adaptation of the volumetric efficiency of the engine to the load imposed on it. What this means is that, under a low engine load, the respective auxiliary piston moves towards the associated working piston and in so doing reduces the volumetric efficiency, whereas under a high engine load the auxiliary piston moves away from the working piston during its induction stroke so that the volumetric efficiency is increased It is obvious that the invention can be implemented in various ways within the scope of the idea of invention. This is particularly true of the embodiment of the operative connection between the crankshafts 17 and 18**, which can also be provided, for example, by an hydraulic transmission of a previously disclosed kind, but also of the size ratios between the respective volumes of the working and auxiliary cylinders and the respective diameters of the working and auxiliary pistons.

It should be noted that the arrangement in accordance with the invention is not restricted to internal combustion engines of the two-stroke or Otto-cycle type, but can be applied to similar engines of the fuel-injection or Diesel type.

I claim:

1. Arrangement for an internal combustion engine of the kind which has a number of working cylinders, a corresponding number of auxiliary cylinders, each of which communicates with an associated working cylinder, and in each working cylinder a working piston which is so arranged as to execute a reciprocating motion inside the working cylinder and which, via a connecting rod, is operatively connected to a first crankshaft, in each auxiliary cylinder an auxiliary piston which is so arranged as to execute a reciprocating motion inside the auxiliary cylinder and which, in a similar fashion to the working piston, is operatively connected to a second crankshaft, and a device acting between the aforementioned crankshafts to ensure that the reciprocating motion of the auxiliary piston occurs at a frequency related to the frequency of the reciprocating motion of the working piston, and to provide angular displacement between the shafts, with a wherein a compression ratio in the respective working cylinders and auxiliary cylinders is dependent upon the loading on the engine at any given time, characterized in that the aforementioned devices are so arranged as to transmit energy originating from the effect of the combustion on the respective auxiliary piston from the second crankshaft to the first crankshaft, and in that the operative connection between the respective auxiliary piston and the second crankshaft, is so arranged so to allow the expansion motion of the auxiliary piston, that is to say its motion away from the working piston, to extend over more than 180° of the rotation of the second crankshaft, and to reduce the lateral forces of the auxiliary piston against the wall of the auxiliary cylinder, which generate frictional losses.

2. Arrangement in accordance with claim 1, characterized in that the aforementioned device comprises toothed belt pulleys on the respective crankshafts, a toothed belt disposed about the belt pulleys, and means for lengthening and shortening one section of the belt at the expense of the other section, in conjunction with which the aforementioned lengthening/shortening is executed so that the desired angular displacement is achieved.

3. Arrangement in accordance with claim 1, characterized in that the operative connection between the respective auxiliary piston and the aforementioned second crankshaft is a connecting rod, and in that the axis of rotation of the second crankshaft is displaced in parallel for a certain distance relative to an imaginary line connecting the central axes of the auxiliary cylinders, in conjunction with which the displacement takes place in a direction which coincides with that in which the crank web of the second shaft faces when the auxiliary piston is on its way into the auxiliary cylinder.

4. Arrangement in accordance with claim 3, characterized in that the aforementioned distance of parallel displacement lies preferably within 15–35% of the diameter of the auxiliary cylinder.

5. Arrangement in accordance with claim 1, characterized in that the operative connection between the respective auxiliary piston and the aforementioned second crankshaft is a rocker arm mechanism of a previously disclosed kind.

6. An internal combustion engine, comprising:

a working cylinder;

an auxiliary cylinder in communication with said working cylinder;

a working piston reciprocatingly disposed within said working cylinder and operatively connected to a first crankshaft via a connecting rod;

an auxiliary piston reciprocatingly disposed within said auxiliary cylinder and operatively connected to a second crankshaft; and a timing device for establishing a relative rotational frequency between said first and second crankshafts and for providing an angular phase displacement between the said first and second crankshafts, said device adapted to transmit rotational energy from said second crankshaft to said first crankshaft, wherein a compression ratio in said working cylinder and in said auxiliary cylinder is dependent upon the loading of the engine at any given time;

wherein said operative connection is such that upon movement of said auxiliary piston away from said working piston, said auxiliary piston causes said second crankshaft to rotate more than 180 degrees.

7. The engine of claim 6, wherein said device comprises a toothed belt pulley on each of said respective crankshafts, a toothed belt disposed around said belt pulleys, sand means for lengthening and shortening a section of said belt at the expense of the other section so that a desired angular displacement is achieved.

8. The engine of claim 6, wherein the operative connection between said respective auxiliary piston and said second crankshaft is a second connecting rod, wherein the axis of rotation of said second crankshaft is displaced in parallel for a given distance relative to an imaginary line connecting the central axis of said auxiliary cylinder, wherein the displacement takes place in a direction which coincides with that in which said crank web of said second shaft faces when said auxiliary piston moves into said auxiliary cylinder.

9. The engine of claim 8, wherein said distance of parallel displacement ranges from about 15% to about 35% of the diameter of said auxiliary cylinder.

10. The engine of claim 6, wherein the operative connection between said respective auxiliary piston and said second crankshaft is a rocker arm mechanism.

11. The engine of claim 6, wherein said auxiliary piston is substantially smaller than said working piston.

12. The engine of claim 6, wherein the frequency at which said auxiliary cylinder reciprocates is at one-half of the frequency at which said working cylinder reciprocates.

13. The engine of claim 6, wherein the frequency at which said auxiliary cylinder reciprocates is the same as that of said working cylinder.

* * * * *